United States Patent [19]
Keable
[11] 4,447,468
[45] May 8, 1984

[54] PHOTOGRAPHIC FILM COATING APPARATUS AND METHOD

[75] Inventor: John B. Keable, Spring Valley, Ohio
[73] Assignee: QMI Corporation, Centerville, Ohio

[21] Appl. No.: 477,205
[22] Filed: Mar. 21, 1983
[51] Int. Cl.³ ..... B05D 3/06
[52] U.S. Cl. ..... 427/54.1; 118/52; 118/56; 118/416; 118/426; 118/502; 118/695; 118/702; 118/703; 118/704; 118/620; 427/240; 427/346; 427/430.1
[58] Field of Search ..... 427/54.1, 346, 430.1, 427/240; 118/56, 52, 416, 423, 426, 502, 695, 696, 699, 702, 703, 704, 620; 354/290, 312, 315, 316, 320, 322, 329, 330, 340, 345

[56] References Cited

U.S. PATENT DOCUMENTS 2,385,653 9/1945 Rockola ..... 118/416
2,388,126 10/1945 Dettle ..... 118/416
2,569,705 10/1951 Briggs et al. ..... 118/423
3,475,672 10/1969 Oltendorf .
3,641,906 2/1972 Orr et al. .
4,112,452 9/1978 Patton .
4,112,453 9/1978 Hutchison .
4,112,454 9/1978 Harvey .
4,178,091 12/1979 Solomon .
4,252,430 2/1981 Michael .

*Primary Examiner*—John H. Newsome
*Attorney, Agent, or Firm*—Biebel, French & Nauman

[57] ABSTRACT

Spindled photographic film discs are coated with an ultraviolet light curable protective coating apparatus which receives a developer spindle carrying a plurality of film discs at a receiving station. Carry-in arms transfer the spindle into a coating station through a door and deposit the spindle at a location where the lower films on the stacked discs are partially submerged in a pool of coating liquid. A drive gear engages a spur gear on the spindle and slowly rotates the spindle for applying the coating evenly to the discs. Carry-over arms engage the spindle and carry it about the circumference of the drive gear, first lifting the spindle above the coating material and then causing the spindle to be spun at a relatively high rate for removing excess material from the discs. The carry-over arms thereafter transport the spindle through a second door and into an ultraviolet curing region while maintaining the rotation of the discs during curing. The carry-over arms thereafter deposit the spindle onto a carry-out conveyor where the spindle may be removed from the apparatus.

The method includes the steps of partially lowering the film disc carried on a spindle to submerge the discs in a pool of coating material, elevating the spindle above the pool and rotating the same to spin off excess coating material, moving the spindle out of the coating region and into an ultraviolet light curing region while continuing the rotation of the spindle and the discs thereto to provide for even curing throughout the film areas of the spindle, and thereafter removing the spindle from the ultraviolet region.

10 Claims, 7 Drawing Figures

PHOTOGRAPHIC FILM COATING APPARATUS AND METHOD

BACKGROUND OF THE INVENTION

This invention pertains to photographic films, and more particularly for method and apparatus for applying protective coatings to the surfaces of films, more specifically film discs. The invention is particularly adapted for use with film disc-type developing apparatus, or generally, film processing apparatus, by means of which a protective durable clear coating may be applied to the exposed surfaces of film carried on film discs.

It is known that ultraviolet curable coating materials of the kinds described in the patents of Nozari, U.S. Pat. No. 4,049,861 issued Sept. 20, 1977 and Lien et al, U.S. Pat. No. 4,156,046 issued May 22, 1979 have particular advantage as an abrasion-resistant coating for photographic films, such as for photographic color negative films popularly used in making color prints. Such protective coating materials have been marketed in the United States by Minnesota Mining and Manufacturing Company under the trade name "3M Photogard". This material applies an optically clear protective coating of approximately 2.5 microns thickness. It features high resistance to abrasion, to static electricity, to finger prints, and to a wide variety of solvents.

Also, the material has about the same index of refraction as the negative material. It prevents the growth of fungus or bacteria on the film and serves to dissipate static electricity. The coating material further tends to eliminate scratches, in that scratches are filled in and no longer are as visible when printing. Further, the coating material provides a smooth surface which reduces light scatter at the surface and enhances printability. A further advantage is that such coated films have enhanced archival characteristics in that air is excluded from the surface of the film which could deteriorate the film and the film dyes.

A particular problem exists, however, in the application of such coating materials to film discs of the kind now commonly used in film disc cameras and as disclosed in Sethi, U.S. Pat. No. 4,194,822 issued Mar. 25, 1980. The film disc has a central aperture about a plastic hub which is concentrically disposed. The hub is permanently attached to the disc and includes a keyway by which the hub can be secured to a keyed spindle for rotation during film processing. The individual films are arcuately positioned about the hub of the disc.

Film discs are commonly developed on spindles in which a plurality of the discs are stacked in side-by-side relationship for sequential application of processing fluids thereto, while the spindle is rotated. The spindle, and the film discs stacked thereon, are moved into successive baths of processing solutions, and transferred from bath to bath by appropriate arms which carry the spindle (and the discs carried thereon) to a drying station where the same films may be air dryed. For example, typical patents showing the film disc and spindle combinations include Michal, U.S. Pat. No. 4,252,430 issued Feb. 24, 1981 and Patton, U.S. Pat. No. 4,112,452 issued Sept. 5, 1978. The spindle itself has now been standardized by Eastman Kodak Company for use in its processors, and is provided to the photofinishing industry for carrying and storing up to 100 disc films. However, the apparatus which has heretofore been provided for the purpose of processing or developing film discs is not suited for the application of ultraviolet curable coatings. The application of the coating material requires the employment of certain shapes and methods which cannot be practiced by existing processing or developing equipment. First, in such coating only the film negatives should be coated. It is undesirable to coat the hub of the disc as that would be wasteful of coating, and could interfere with the proper utilization of a magnetic data storage area provided on the hub. The coating material itself is relatively expensive, while exceedingly thin film thicknesses in the range of 2 to 3 microns is ample. Further a minimum of coating material applied is desirable to prevent coating build-up, to prevent sags or ridges from forming, and to prevent interference with the definition and resolution of the image.

A further requirement is that the coated discs be subjected at the proper time to ultraviolet radiant energy for the purpose of curing. Such apparatus is not now presently available in processing or developing equipment.

SUMMARY OF THE INVENTION

The present invention is directed to an apparatus and method of applying a protective ultraviolet curable coating, such as the "Photogard" protective coating described above, to the surface of the individual films on film discs. The apparatus of this invention is particularly adapted to receive fully developed and dried discs stacked on spindles from existing processing equipment, such as from the processing apparatus disclosed in the above-identified patent of Michal, U.S. Pat. No. 4,254,430. However, since the coating apparatus of the present invention is capable of coating and drying such disc spindles at a rate which exceeds the development rate of existing commercial processing apparatus, one such coater can be used to service more than one processing machine. For this purpose it is not necessarily economical to attach the coating apparatus directly to a processor, but rather to place the apparatus at a position where it may be manually loaded and operated by an operator by receiving film spindles from one or more processing machines.

The preferred embodiment of the invention provides a method and apparatus for applying the protective ultraviolet curable coating to the surface of films on discs of films, and the method and apparatus provides for partially lowering a spindle carrying a plurality of the discs in such a manner as to submerge the films in a confined pool or tank of coating material while slowly rotating the spindle, followed by the lifting of the spindle above the pool and then rotating it at a rate of speed so as to spin off the excess material, followed then by the movement of the spindle out of the confined pool region into a region where the same is cured by ultraviolet light while continuing the rotation of the spindle and discs thereon at a rather slow rate. The apparatus of the invention thus includes spindle handling means in the form of loading or transfer arms which are positioned to engage a spindle and lift the same from a rest or entrance position at the inlet to the device, through a door and to lower the same so that the discs are partially submerged in a pool of coating liquid. At this point the loading arms disengage from the spindle. The spindle itself is commonly provided with a small spur gear at one end. This spur gear, at the coating station, is in contact with a relatively large diameter drive gear, which engage the spindle at the coating station and causes it to rotate slowly a few turns so that each negative or film frame is submerged in the coating. A second set of transfer arms are mounted on a shaft in common with or coaxial with the drive gear, and have an effective spindle support radius which is equal to the pitch diameter of the drive gear.

The spindle is now engaged by such second set of arms at the coating station and lifted about the drive gear within the confined space and held in elevated position out of the pool while the drive gear is driven at a relatively higher rate of speed, to spin the spindle and the discs thereon for the purpose of flinging off excess coating material. Finally, the second set of arms walk the spindle over the circumference of the drive wheel, as the same is coasting down to its slow speed, an ultraviolet light blocking door is opened, and the spindle passed therethrough into an ultraviolet curing region. The door is closed behind the spindle to prevent ultraviolet light from entering into the coating chamber. The second set of arms continue to move the spindle through the ultraviolet curing chamber and about the circumference of the drive gear and deposit the spindle on a conveyor which carries the now cured film discs to a discharge station. While curing the spindle rotates at the slow rate to prevent the formation of ridges and sags in the coating material.

It is accordingly an important object of this invention to provide method and apparatus for coating the individual films on film discs with an ultraviolet curable coating.

Another of the invention is to provide method and apparatus, as outlined above, in which a plurality of discs have the films thereon coated, utilizing a minimum of coating material, with the excess removed therefrom by spinning, followed by curing in ultraviolet light while continuing to rotate the discs, to prevent runs and sags in the coating.

A still further object of the invention is the provision of apparatus for applying and curing a protective clear coating on films on film discs, including a container or a tank of such coating in which discs on a spindle are partially lowered into the coating liquid, rotated, and then elevated above the coating liquid and spun at relatively high speed to remove excess coating material, prior to curing.

A further object of the invention is the provision of coating apparatus in which spindle carrying arms are mounted on a shaft in common with the axis of a drive gear which engages the spur gear of a spindle, for supporting the spindle while it is rotated by the drive gear to spin off excess material, and for moving the spindle in an arcuate path about the circumference of the gear during curing.

These and other objects and advantages of the invention will be apparent from the following description, the accompanying drawings, and the appended claims.

DETAILED DESCRIPTION OF THE PREFERRED EMBODIMENT

Figure 1:
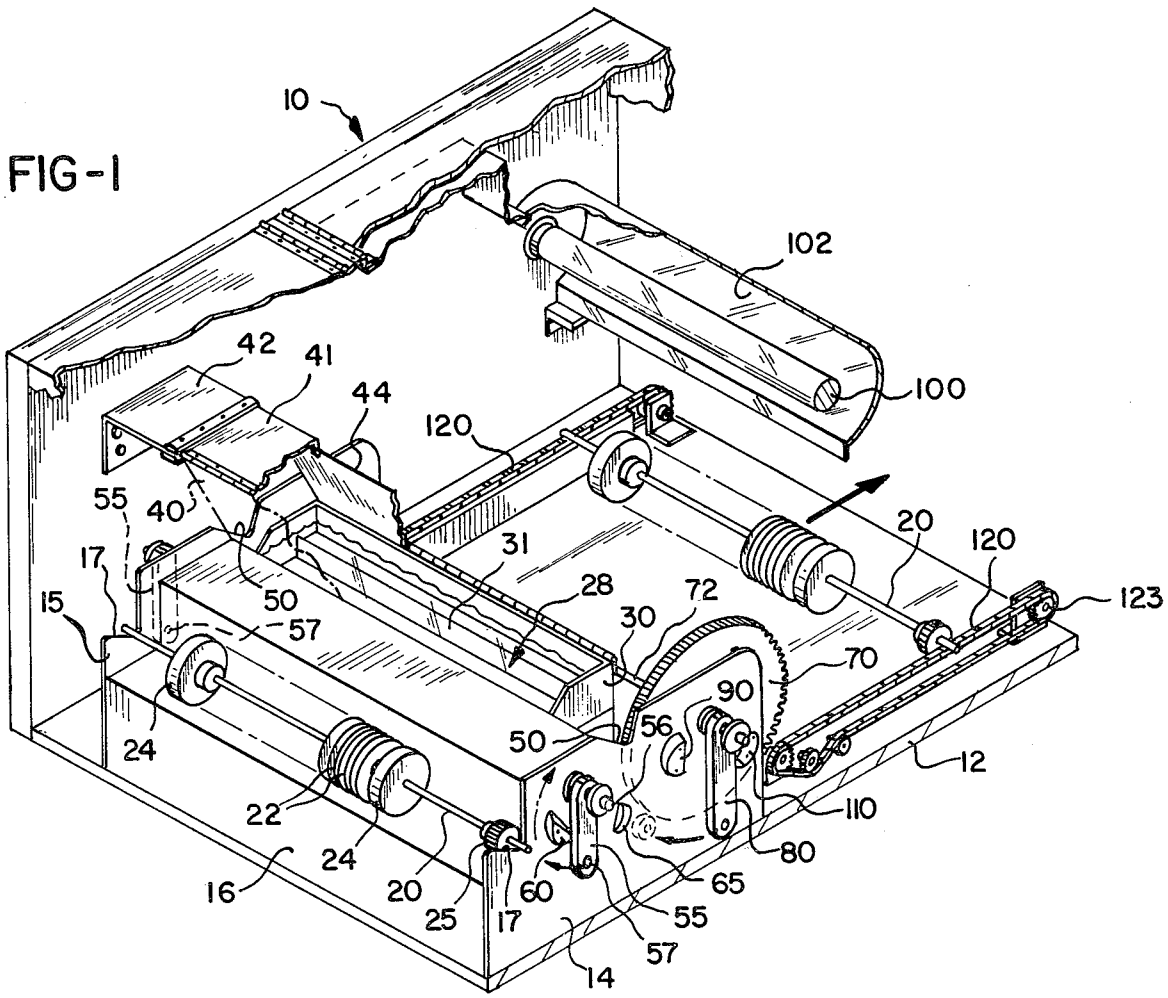
FIG. 1 is a broken-away perspective view of coating apparatus in accordance with this invention.

Referring to the figures of the drawing which illustrate a preferred embodiment of the invention, apparatus for applying a protective coating to film discs carried on a spindle of discs, is illustrated in FIG. 1 as generally including a cabinet or housing 10 formed with a mounting base 12. A portion of the cabinet is broken away for the purpose of illustrating the apparatus of the present invention. The major part of the coating apparatus is carried on the base plate 12 and includes a first metal side plate 14, an opposite complementary side plate 15 interconnected by a front plate 16. The side plates 14 and 15 are notched as indicated at 17 to define a receiving station to receive the opposite ends of a developing spindle 20 with the stacked film discs 22 positioned between the side plates. The spindle 20 may be the same as that shown in the above-referenced patent of Michal, U.S. Pat. No. 4,252,430 and supports the individual film discs 22 in a parallel hub-to-hub relationship along a keyway, such that the spindle and film discs may be rotated about a common horizontal axis during the prior processing steps and during the coating steps. The spindle further includes a pair of end caps 24 which are slidable along the spindle for the purpose of securing selected numbers of discs 22 on the spindle. The one end of the spindle 20 is provided with a small spur gear 25 by means of which the spindle may be rotated. The ends of the spindle extend slightly beyond the side walls 14 and 15.

The coater housing 10 has a coating station indicated in general by the reference numeral 28. Means forming a pool of coating material is located at the coating station between the side walls 14 and 15, in the form of a transversely extending pan or tank 30. The pan 30 defines a pool of coating material 31, which is preferably of the ultraviolet light curable type as disclosed in U.S. Pat. Nos. 4,049,861 and 4,156,046, as described above, and is normally fully enclosed by movable doors, described below, to form a coating region. As viewed in FIGS. 2 and 3, the pan 30 includes a transversely oriented bottom 32 for containing a quantity of coating material 31. The precise level of the coating material 31 is defined by a dam or weir 34 carried on a vertical internal angle face formed on the bottom 32.

Figure 3:
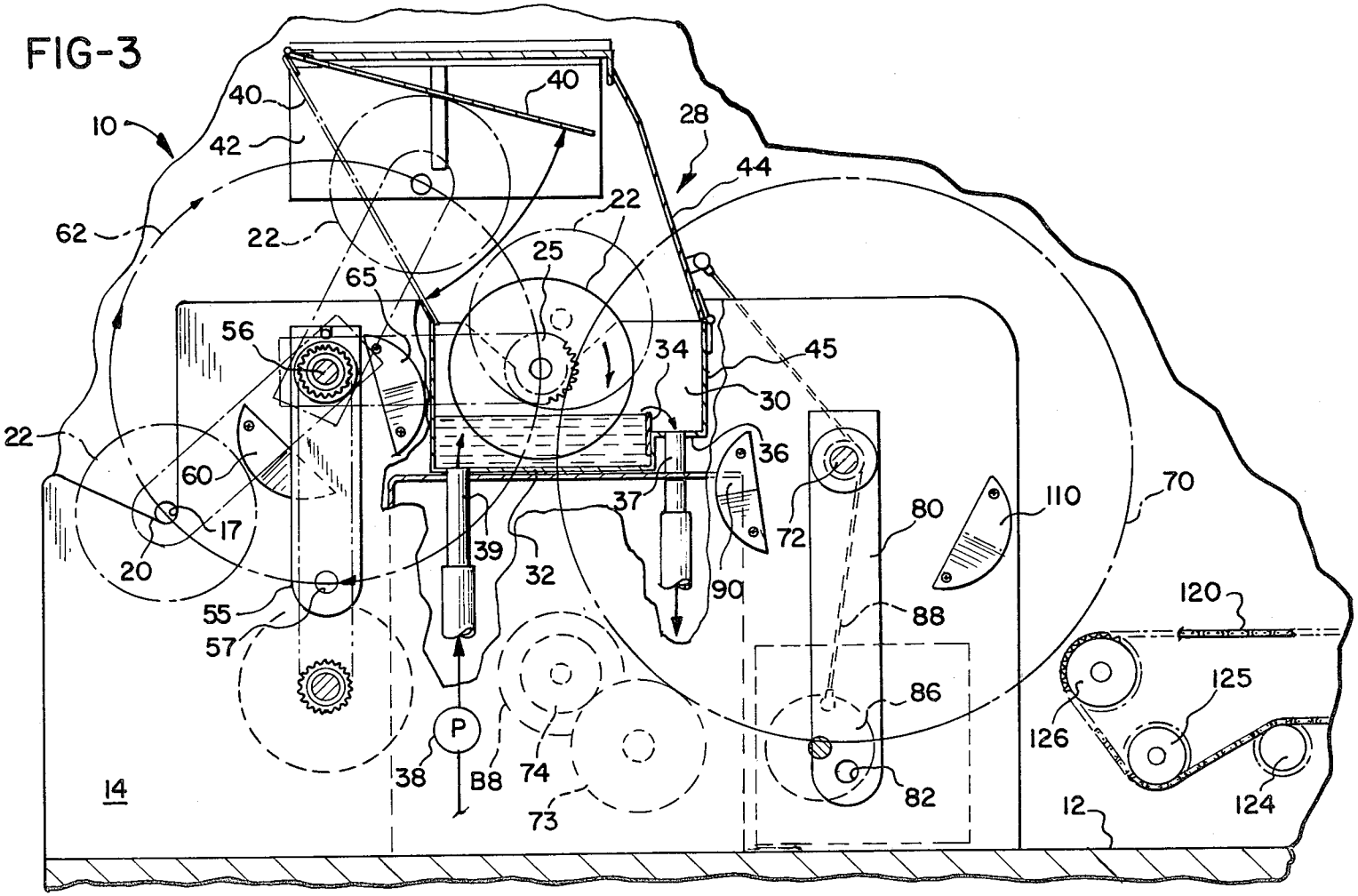
FIG. 3 is an enlarged side view, partially in schematic form, showing the spindle support arms in several moved positions as it carries a spindle through the coating apparatus.

It is important to maintain the depth or level of the coating material so that only the individual films or negative portions of the discs are coated, to prevent the coating material from being applied to the hubs, while assuring that the portions are completely covered. As best shown in FIG. 3, the pan 30, at the bottom ledge 36, is provided with a drain 37 through which excess material is removed to a container of such coating material, not shown. A pump 38 constantly supplies a small quantity of the coating material through a nipple 39 which opens into the bottom 32 to maintain the level of coating material at the top of the weir 34.

The coating station 28 is form as an enclosed region, so that admittance into the interior above the pool is through a pivoted entrance door 40 hinged on a transverse generally horizontal cover plate 41. The cover plate 41 is carried on the sides of the cabinet by brackets 42. The exit from the coating region is through an exit door 44 hinged along the forward wall 45 of the pan 30. The coating region is fully enclosed so that all excess material is either returned directly to the pool formed within the pan or washes down the inside surfaces of the entrance and exit doors and returns to the main supply for recirculation. The pan 30 may be conveniently removed for cleaning or service separate from the cover plate 42 and the door 40.

Figure 2:
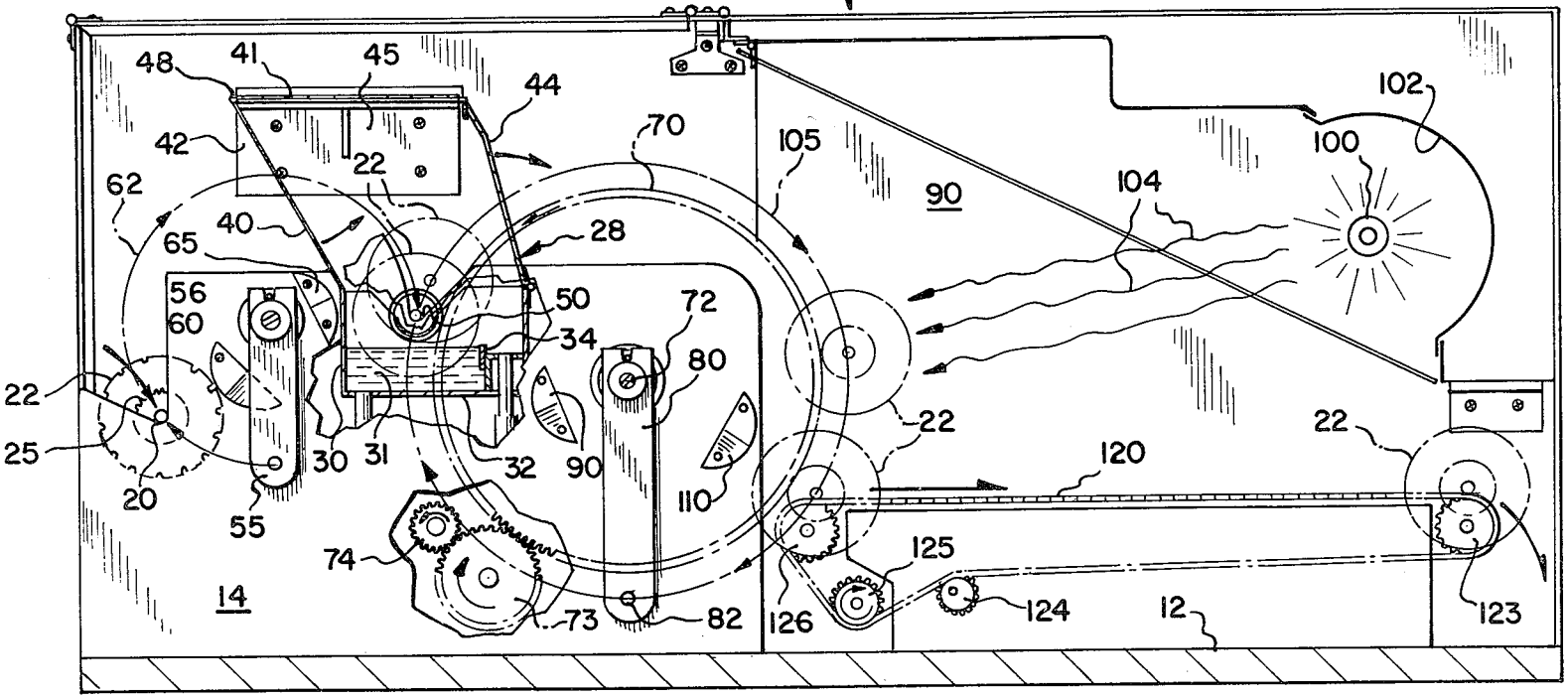
FIG. 2 is a side elevation, partially broken away, of the apparatus,of FIG. 1.

The side walls 14 and 15 are notched at the coating station, as indicated at 50 in FIGS. 1 and 2, to receive the ends of a spindle 20 to support the discs 22 for coating by the coating material 31 in the pan 30. When the spindle 20 is resting on the side walls within the notches 50, the relationship of the depth of the coating material is established with respect to the position and extent of insertion of the discs 22, such that only the lowermost films on the discs are submerged.

Figure 5:
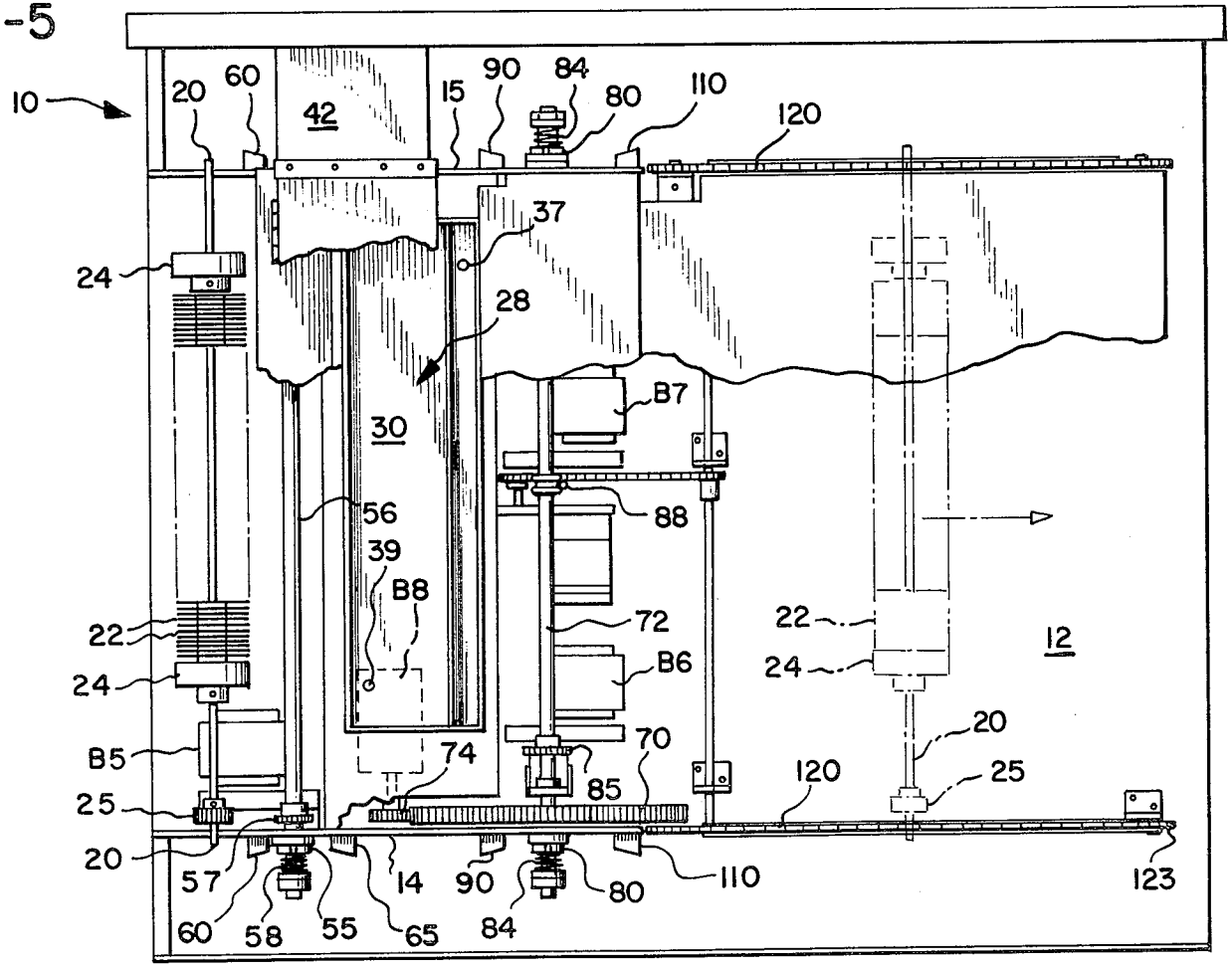
FIG. 5 is a top elevation, partially broken away, of the apparatus.

Means for transferring a loaded spindle, as shown in FIG. 1, from the receiving station into the coating station includes a first pair of spindle-engaging loading arms 55, which may be referred to as loading arms. Each arm 55 is positioned adjacent an outer surface of a side plate 14 or 15 and connected for rotational movement on a common transverse shaft 56, as shown in FIG. 5. The loading arms 55 are rotated through appoximately 360° by a carry-in motor B5 connected by a chain and sprocket 57 to the shaft 56. The shaft 56 extends through the side walls 14 and 15, and the arms 55 thereon are biased by springs 58, FIG. 5, into an inner spindle carrying position, but may be moved outwardly by compression of the springs 58 to engage the ends of the spindle 20 in openings 57. Thus, the arms 55 which are normally in the position as shown in full line in FIGS. 2 and 3, when caused to rotate, are spread outwardly or apart, when the arms engage half cams 60. The half cams 60 drop the arms with the spindle receiving opening 57 over the extended ends of the spindle 20, thereby engaging the spindle between the arms 55. Continued rotation of the arms 55, in the direction of the arrow 62 as shown in FIGS. 2 and 3, causes the spindle and the assembled discs thereon to engage the entrance door 40, causing it to swing inwardly into the enclosed coating region. When the spindle reaches the region of the notches 50, the arms 55 are again spread apart by full cams 65, causing the arms to release the spindle where it drops into the side plate notches 50 with the lowermost film elements immersed within the pool of coating material 31.

The position of the spindle is now as shown in FIG. 3. At this position, the spur gear 25 is in driven relation with a relatively large diameter spindle drive gear 70. The gear 70 is mounted adjacent the inside surface of the plate 14 for rotation on a shaft 72 (FIG. 5) extending between the walls 14 and 15. The rotation of the gear 70 is controlled by a main gear drive motor B8 connected to drive the gear 70 through an intermediate idler gear 73 and a small gear 74 on the motor shaft. The gear 70 is normally continuously rotated by the motor B8 at a relatively slow rate of rotation so that as soon as the spur gear 25 comes into contact with the teeth of the drive gear 70, with the spindle resting within the notches 50, it begins slowly to rotate the discs within the pan 30, through approximately four complete revolutions of the discs. For example, this rotation of the spindle 20, by the spur gear 25, may be at the slow rate of about one revolution per second, more or less, so that the discs are fully coated in about four to five revolutions in about as many sections.

The apparatus includes a second pair of arms means which are mounted on the side wall and which are engageable with the spindle for the purpose of elevating the same above the pool, supporting the spindle while the same is spun to remove excess coating liquid, and subsequently to carry the spindle into an ultraviolet light curing region. This includes the arms 80 which are mounted for rotation with the shaft 72 in generally co-axial relation with the gear 70. The arms 80 are fixed to the shaft 72 and are driven by the shaft, with one of each of the arms being mounted on the extended ends of the shaft adjacent each of the respective side walls 14 and 15. The arms 80 are also provided with spindle-receiving apertures 82 adjacent the ends thereof. The radius from the axis of rotation of the apertures 82 is approximately the same as the pitch diameter of the gear 70, so that when the arms engage a spindle, the spindle is moved about the circumference of the gear. As in the case of the arms 55, the arms 80 are spring biased by springs 84 to an inner spindle gripping position, but are movable outwardly by cams positioned on the respective side walls to engage or disengage a spindle.

Figure 4:
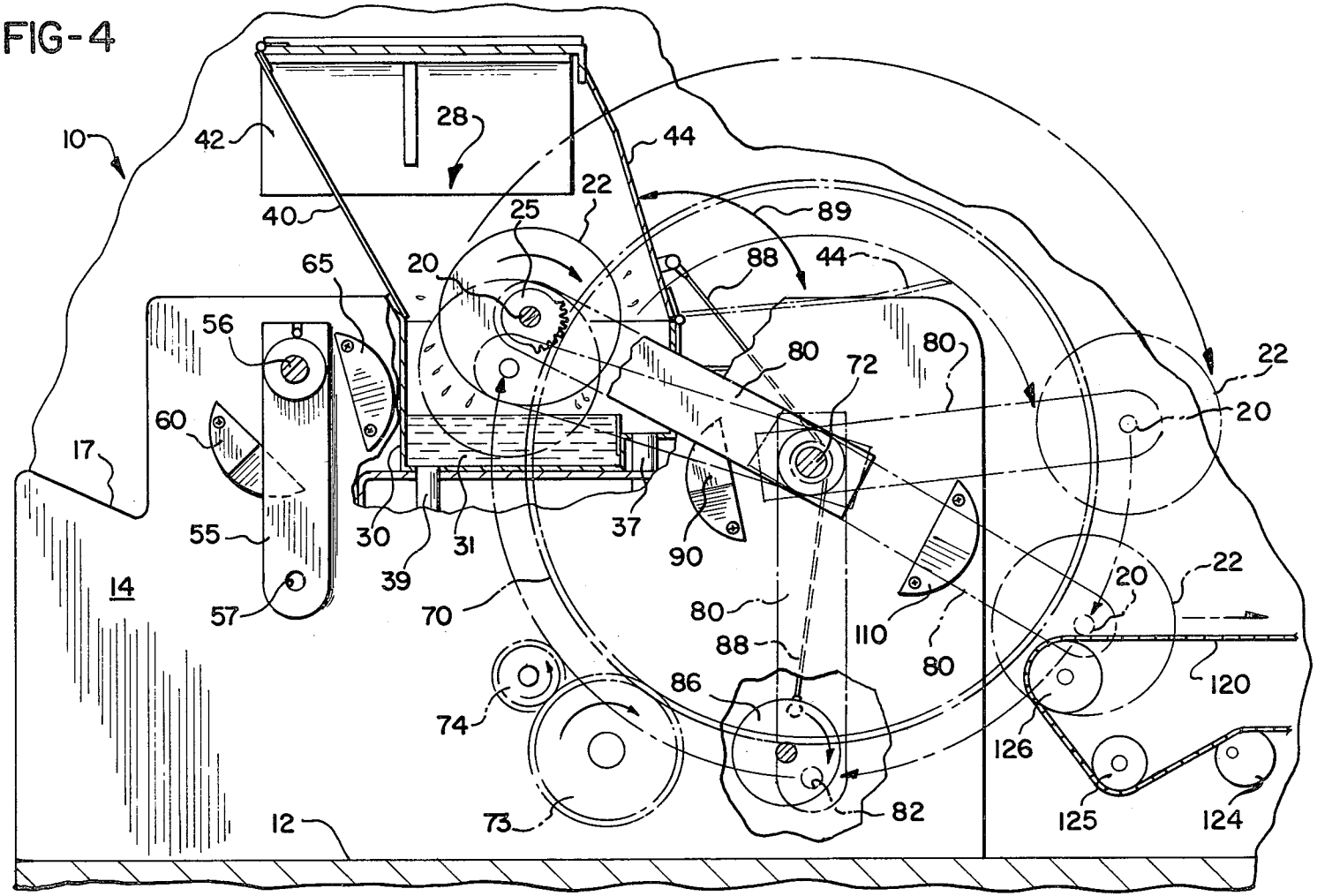
FIG. 4 is a view similar to FIG. 3, but showing the arms and spindle in moved positions.

The rotation of the arms 80 is controlled by a carry-over motor B6 connected to drive the shaft 72 through a chain and sprocket arrangement 85 as shown in FIG. 5. The exit door 44, of the coating pan 30, is normally held in a closed position as shown in FIG. 3, but is opened by a crank 86 (FIG. 4) driven by exit motor B7 and a flexible pull cord 88, as shown in FIG. 3 to an open position, by movement as indicated by the arrow 89.

After the discs 22 on the spindle 20 have been coated, as described above, the exit arms 80 are caused to rotate in a clockwise direction as viewed in FIGS. 2 and 3 to engage the ends of spindle 20, by movement over the half cams 90 which spread the arms apart against the springs 84 and drop the same so that the spindle ends enter the openings 82. The arms 80 raise the spindle from the full line position shown in FIG. 3 to the full line position shown in FIG. 4, within enclosed space of the coating station 28, where the discs are now elevated out of the pool of coating material. The spindle gear 25 is maintained in engagement with the gear 70.

At this point, the gear drive motor B8 is activated to rotate the gear 70 at a relatively high rate of speed, to impart a spinning motion to the spindle 20 and the discs stacked thereon, to fling off excess coating material. For example, the spindle may be rotated at about 900 rpm. It has been found that speeds substantially lower than 900 rmp, while reasonably satisfactory, may not remove all of the excess material, and may leave a ridge of material about the peripheral edges of the individual films, while speeds in substantially in excess of 900 rmp are not required and produce no substantial benefit.

The excess material may thus be spun off in about 5 to 10 seconds time, at which point the motor B8 coasts down to its slow speed operation and the arms 80 are indexed to carry the spindle out of the coating region, accompanyied by the opening of the exit door 44 and into an ultraviolet curing region 90. The path of movement of the spindle 20 is arcuate and about the pitch diameter of the gear 70 as carried by the arms 80 so that the spur gear 25 remains in engagement with the gear 70.

When the spindle 20 exits the coating chamber through the door 44 it enters the curing region 90. It is subject to ultraviolet curing rays from a UV lamp 100. The lamp 100 is positioned in a forward portion of the cabinet 10, as best shown in FIGS. 1 and 2, and is provided with a back reflector 102 to direct its rays, as shown by the arrows 104, to the slowly rotating discs on the spindle, as the spindle is carried clockwise as viewed in FIG. 2 about the path of the arrow 105. The door 44 is promptly closed behind the discs on the spindle to prevent ultraviolet curing rays from entering into the interior of the coating chamber where it could result in unwanted curing of the coating material. The lamp 100 may be of the mercury vapor type rated at 85 watts per inch or more, and the curing of the coated material, which now is in the order to 2 to 3 microns in thickness, is accomplished within a few seconds, accompanied by continuous movement of the exit arms 80 about the path 105. It is, however, particularly important that the discs continue to be rotated during curing, to reduce or eliminate the possibility of sags and runs forming in the coating material, and to assure uniform curing throughout the circumference of the discs.

When the curing is substantially completed, the arms 80 each engage a full cam 110, as shown in FIGS. 2 and 3, and disengage from the spindle to place the spindle ends on the upper run of a pair of moving chain conveyors 120. As shown in FIG. 1, the pair of the conveyors 120 are provided along the edge of the base 12, to receive the spindle ends and carry the now cured spindle and discs out of the cabinet. The chains are carried over forward idler rollers 123, a tension roller 124, a chain drive sprocket 125, and a rear idler 126, in substantially conventional manner.

Figure 6:
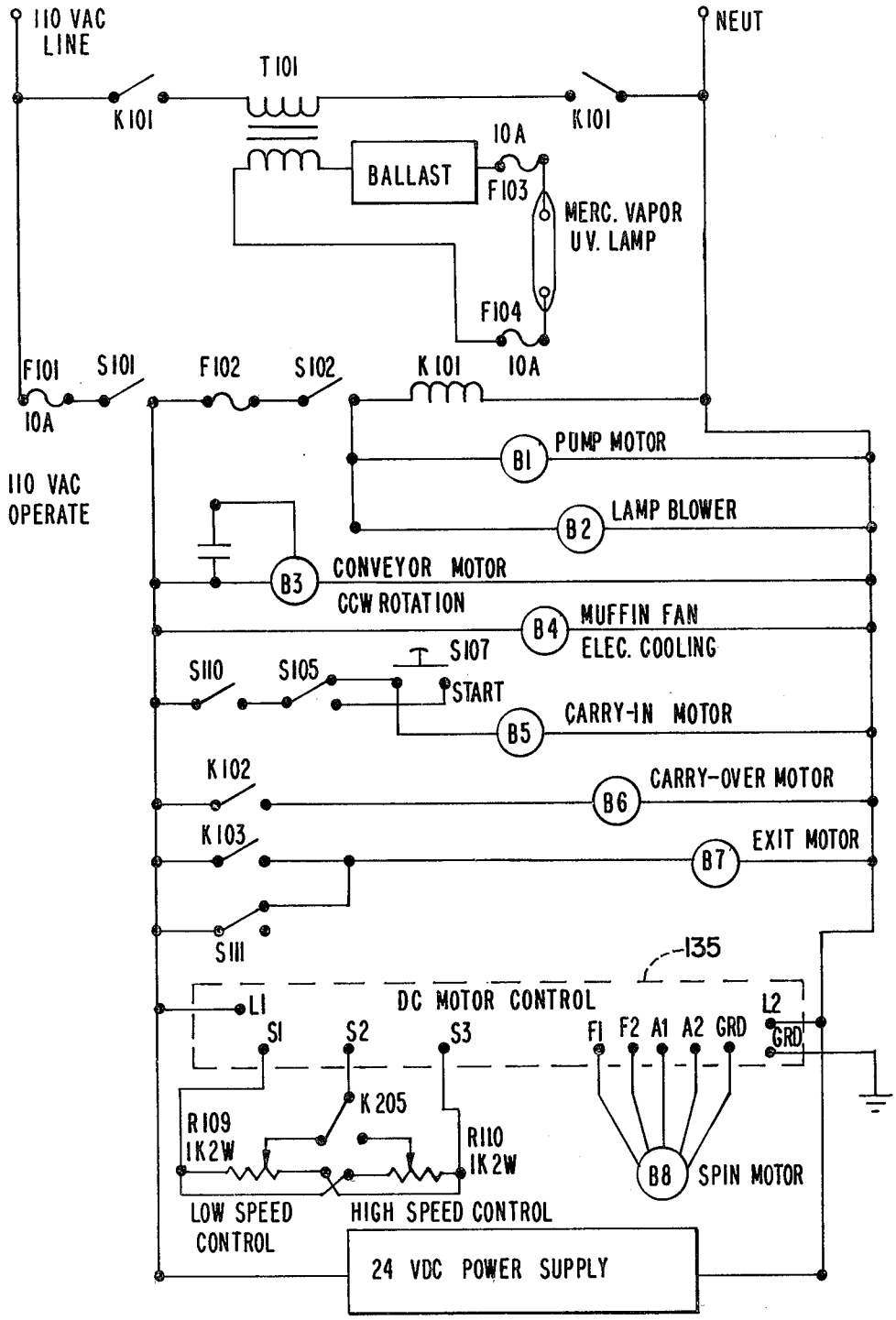
FIG. 6 is a control diagram of the high voltage portion of the control.
Figure 7:
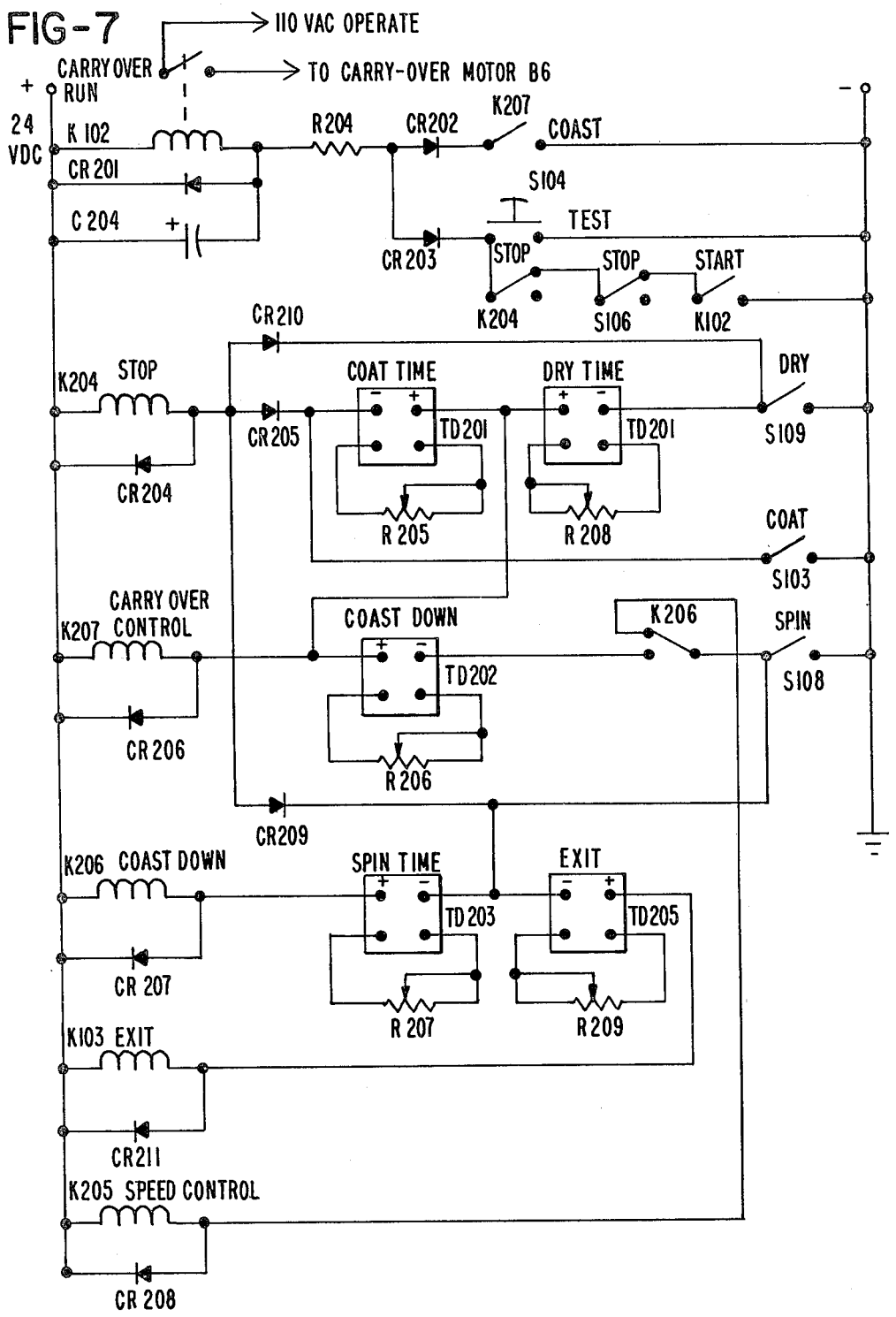
FIG. 7 is a further diagram of the low voltage portion of the control.

The overall operation of the coating apparatus and method of the invention may be more fully understood by reference to the wiring diagrams as shown in FIGS. 6 and 7. FIG. 6 shows the high voltage portion of the circuit, and the 24 volt DC or low voltage portion is shown in FIG. 7.

Referring to FIGS. 6 and 7, the main power switch S101 is closed, to start the conveyor motor B3, which drives the conveyor 120. It is convenient to allow the conveyor motor to operate continuously. The switch S101 also energizes the 24 volt DC power supply and operates the cooling fan B4. The operator then closes the lamp power switch S102 which energizes relay K101, applying power to the UV lamp transformer T101, and to the UV lamps 100. At the same time, switch S102 applies power to a pump motor B1 which operates the pump 38 to supply the coating material to the pan 30 from a reservoir or source of such material. A short period of time, such as about 5 minutes, should now elapse for the curing section to come up to temperature.

Push button switch S107 is used to start a cycle of operation. Switch S107 may be a momentary push/button switch which is manually operated by the operator. Power is now applied to the carry-in motor B5 through the contacts of a cycle interlock switch S110, a carry-in motor switch S105 and the start switch. The interlock switch S110 is normally open, but is closed when the carry-over arms 80 are in their lowered or rest position by a cam carried on the arm shaft which signals that there is no spindle in process. Switch S105 signals that the carry-in arms 55 are also in their lowered or down position, as shown in full line in FIG. 1, and is operated by a cam off of the shaft for the arms 55. With S105 will assume the position shown in FIG. 6 just as soon as the arms 55 begin to move. The carry-in motor B5 will drive the arms 55 in 360° cycle of rotation, and switch S105 will be re-opened when the motor has completed its travel, thus stopping the carry-in motor. The motors which are employed to drive the arms, namely B5 and B6, are preferably of the automatic braking type, so that when the power is removed, a brake is applied to stop the motor without undue coasting. In such a cycle of operation, the arms 55 rotate over the lead-in one-half cams 60, engage the end of the spindle, and carry the loaded spindle about the circular path 62. When the arms engage the full cams 65, the spindle is released, and it drops down into the notches 50 while supporting the films in partially submerged relation to the coating material within the pan 30.

When the spindle is dropped into the pan, as shown in FIGS. 2 and 3, the spindle gear 25 comes into engagement with the drive gear 70 and the spindle begins to rotate at slow speed since motor B8 runs continuously off the low voltage source. After releasing the spindle in the coating tank, the carry-in motor B5 returns the arms 55 to the home position and power is removed from motor B5. A switch S103 (FIG. 7), depressed by the spindle in the coating notch 50, connects the negative terminal of the coat timer module TD 201 to ground, and this timer times out and after a short period of time, as adjusted by resistor R205, and internally shorts its negative terminal to its positive terminal, thus closing the circuit therethrough and energizing the carry-over control relay K207 through the contacts of the switch S103. The contacts of relay K207 now close, applying power to the carry-over relay K102 and starting the carry-over motor B6 which drives the arms 80. Power is retained on the carry-over motor B6 through the contacts of relay K204 and switch S106. Switch S106 has normally closed contacts which are closed just as soon as the arms 80 move, and remain closed for a full 360° cycle of operation, and then open upon the completion of the cycle, in a manner similar to the switch S105 associated with the arms 55.

The gear drive motor B8 operates from a DC motor control circuit 135, as shown in FIG. 6. Normally, the motor B8 operates in its low speed mode. The motor control circuit 135 may be of the type disclosed in the patent of Oltendorf, U.S. Pat. No. 3,475,672 of Oct. 28, 1969. The low speed operation is set by potentiometer R109, and the high speed set by potentiometer R110, as controlled by the position of relay contact K205.

The arms 80 will now lift the spindle 20 and the discs thereon above the level of the coating material in the pan 30 so that there is about ¼" clearance between the periphery of the discs and the coating material. At this time the coat switch S103 is released and the module D201 is reset, de-energizing the carry-over control relay K201 and stopping the arms 80. This is the location for high-speed spin, and at this location the carry-in arms 80 engage a spin timer switch S108 which closes and applies power to relay K205, transferring motor B8 from slow speed to high speed operation. At the same time, the spin timer module TD203 is started, the exit time module TD205 is also started, and the stop relay K204 is energized.

The spin timer module TD203 times out, after a few seconds, and energizes the coast down control relay K206. The normally open contacts of K206 now close to energize module TD202 and de-energize relay K205. The normally open contacts of the speed control relay K205 now open, reconnecting the DC motor speed control circuit 135 to the low speed position, permitting the spin motor B8 to coast down to its low-speed setting.

When the exit timer D205 times out, it energizes the exit door relay K103 through the contacts of the spin timer switch S108, causing the exit door motor B7 to open the door 44. The contacts of switch S108, which are normally open, are held closed by a cam operated from the arms 80, when the arms are in the spin position, as previously noted. Power is maintained on the door motor B7 through the normally closed contacts of a switch S111. The coast down timer module TD202 times out which re-energizes the carry-over relay K207 through the contacts of relay K206 and the switch S108. The contacts of relay K207 close, thus re-energizing the carry-over run relay K102 and restarting the carry-over motor B6.

A cam on the carry-over motor shaft associated with the arms 80 moves off of the spin-timer switch S108, opening the switch, and resetting modules TD 203 and TD 205. Power is retained on the carry-over motor B6 through the contacts of relay K204, switch 106 and the carry-over relay K102. The carry-over motor and the arms 80 thus carry the spindle through the now open door 44 and into the curing section. A timer switch S109 is now operated to initiate a curing timer TD204 and re-energizing relay K204 thus again removing power from the carry-over motor B6, so that the spindle will dwell in the curing station.

When the timer TD204 times out, it again re-energizes the carry-over control relay K207 through the contacts of switch S109, restarting motor B6.

When motor B6 is again restarted, it moves off the contacts of the timer switch S109, thus resetting the timer module TD204 and de-energizing the carry stop-over relay K204 and the control relay K207 while power is retained on motor B6 through the contacts of relay K204, the switch S106 and the relay K102.

The cams 110 now release the spindle with the cured discs thereon, onto the conveyor 120, and the carry-over motor B6 returns the arms 80 to the home position, shown in full lines in FIG. 2. Power is then removed from the motor B6 when switch S106 is opened, thus completing a cycle of operation.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. The method of applying a protective ultraviolet curable coating to the surface of film on discs of film carried on spindles, comprising the steps of:

partially lowering a spindle carrying thereon a plurality of such discs to submerge the films thereon in a pool of such coating and slowly rotating the spindle to coat each film carried thereon with said coating, raising the spindle and discs above the pool and rotating the spindle at a rate of rotation substantially in excess of the rate of rotation during coating, to spin off excess coating from the films carried thereon, moving said spindle out of the region of said pool into a region of ultraviolet curing light while continuing the rotation of said spindle and discs thereon, maintaining said spindle in said ultraviolet light a time sufficient for substantial curing of said coating thereon, and removing said spindle with said discs thereon from said ultraviolet region.

2. The method of claim 1 in which the rate of rotation of said spindle in said ultraviolet region is substantially the same as the rate of rotation of said spindle during coating of material on said films.

3. The method of claim 1 in which the rate of spinning to remove excess coating material following coating is sufficient to remove such excess material free of the formation of a ridge of material along the outer terminal edges of the films on the discs.

4. The process of claim 3 in which said spinning rate of said spindle is about 900 rpm.

5. Apparatus for coating film discs on a disc carrying spindle for applying an ultraviolet curable liquid coating to the individual films carried on such discs, comprising:

means defining a pool of such coating, means supporting such spindle for rotation with discs stacked thereon to a depth less than one-half the diameter of such discs so that only the lowermost films thereon are submerged in said pool, spindle rotating means engageable with said spindle when said spindle is at said supporting means and operable to rotate said spindle slowly at said supporting means for applying such coating to said discs, arm means elevating said spindle and discs above the level of said pool while maintaining engagement with said spindle rotating means and operable to rotate at a relatively high rate of speed for removing excess coating, an ultraviolet curing lamp spaced from said pool and providing an ultravilet curing region, said arm means being operable to move said spindle into said curing region while maintaining engagement with said rotating means for curing by ultraviolet energy during continued rotation of said spindle.

6. Apparatus for applying coating material to the individual films of film discs stacked on a developing spindle, comprising:

housing means forming a receiving station for supporting such spindle with discs stacked thereon, said housing having a coating station including transversely oriented pan means defining a pool of such coating material for receiving a peripheral portion of said discs on a spindle, a first pair of arms rotatably mounted on said housing means engageable with said spindle at the ends thereof and movable by rotation to carry said spindle in a sequence of operation into said coating station, support means on said housing at said coating station for supporting said spindle with a portion of said dics submerged in said spool, gear means engageable with said spindle at said support means, drive means connected to said gear means for rotating said spindle to apply coating material to the film portions thereof, a second pair of arms rotatably mounted on said housing and engageable with said spindle at said coating station to elevate said spindle above the liquid level of said pool in said pan means while maintaining engagement of said spindle with said gear means, said drive means operable to rotate said gear means at a higher rate of speed for causing said spindle to spin on said second arm means to fling off excess coating material, said housing having a curing station including a source of curing energy, and said second arm pair movable to carry said spindle out of said coating station to subject said spindle and the discs thereon to energy from source.

7. Apparatus for applying coating material to the individual films of film discs stacked on a developing spindle, comprising:

housing means forming a receiving station for supporting such spindle with discs stacked thereon, said housing means having a coating station including transversely oriented pan means defining a pool of such coating material for receiving a peripheral portion of said discs on a spindle, a first pair of arms rotatably mounted on said housing means engageable with said spindle at the ends thereof and movable by rotation to carry said spindle in a sequence of operation into said coating station, support means on said housing at said coating station for supporting said spindle with a portion of said dics submerged in said spool, gear means engageable with said spindle at said support means, drive means connected to said gear means for rotating said spindle to apply coating material to the film portions thereof, a second pair of arms rotatably mounted on said housing and engageable with said spindle at said coating station to elevate said spindle above the liquid level of said pool in said pan means while maintaining engagement of said spindle with said gear means, said drive means operable to rotate said gear means at a higher rate of speed for causing said spindle to spin on said second arm means to fling off excess coating material, said housing having a curing region including an ultraviolet lamp, ultraviolet light blocking means at said coating station normally preventing ultraviolet light at said curing region from entering said coating station and movable to permit exit of the spindle therefrom, and said second arm pair movable to carry said spindle out of said coating station into said curing region to subject said spindle and the discs thereon to energy from said lamp.

8. A coater for applying ultraviolet curable liquid coating to the films on film discs stacked on a disc-carrying spindle, comprising:

a housing having a pair of spaced apart side walls, a pan extending transversely of said side walls for receiving a quantity of said liquid coating material, means for maintaining the coating material in said pan at a desired level, means confining said pan including a transverse entrance door through which a spindle carrying such discs may be moved for immersion in said pan, a transverse exit door on said pan through which said spindle and coated discs may be moved for ultraviolet curing, means between said doors and above said pan defining an enclosed space for spinning off the excess of material from said discs, said entrance and exit doors being positioned when closed to drain off material for recirculation to said pan, a first pair of arms, one each positioned at each of said side walls, a common shaft connecting said arms, said first pair of arms having means adjacent the ends thereof for engaging said spindle at its opposite end upon rotation of said arms by said shaft, said arms being proportioned to move said spindle through said entrance door into said enclosed space, means on said side walls engageable with said arms when said spindle is in said enclosed space for causing said arms to disengage said spindle, means in said side walls above said pan for receiving and supporting said spindle for coating at a precise height above said coating material, a spindle drive gear engageable with said spindle at said supporting means, means connected to said gear for causing said gear to drive said spindle by rotation thereof for coating the films on said discs, a second pair of spindle-receiving arms, one each mounted on each of said side walls, a common shaft connected said second pair of arms for rotation together about the axis of rotation of said gear, said second pair of arms being provided with means adjacent the ends thereof engageable with the respective ends of said spindle upon rotation of said arms for supporting said spindle substantially at the pitch diameter of said gear, motor means operable to drive said second pair of arms to engage said spindle and elevate said spindle above said pan out of contact with said material while maintaining engagement of said spindle with said gear whereby said spindle may be driven by said gear at an increased rate of rotation for spinning off excess coating material, means for causing said second arm pair drive motor means to rotate said spindle through said exit door, a curing lamp between said side walls and directed upon said spindle during movement thereof by said second pair of arms beyond said exit door for curing said material, and means on said side wall engageable with said second pair of arms following curing for causing said second pair of arms to release said spindle.

9. Apparatus for coating film discs on a disc carrying spindle for applying an ultraviolet curable liquid coating to the individual films carried on such discs, comprising:

means defining a pool of such coating, means supporting such spindle for rotation with discs stacked thereon to a depth less than one-half the diameter of such discs so that only the lowermost films thereon are submerged in said pool, spindle rotating means engageable with said spindle when said spindle is at said supporting means and operable to rotate said spindle slowly at said supporting means for applying such coating to said discs, arm means elevating said spindle and dies above the level of said pool while maintaining engagement with said spindle rotating means and oeprable to rotate at a relatively high rate of speed for removing excess coating, an ultraviolet curing lamp spaced from said pool and providing an ultravilet curing region, said arm means being operable to move said spindle into said curing region while maintaining engagement with said rotating means for curing by ultraviolet energy during continued rotation of said spindle.

10. A coater for applying ultraviolet curable liquid coating to the films on film discs stacked on a disc-carrying spindle, comprising:

a housing having a pair of spaced apart side walls and a bottom, a pan extending transversely of said side walls for receiving a quantity of said liquid coating material, means for maintaining the coating material in said pan at a desired level, means confining said pan including a transverse entrance door through which a spindle carrying such discs may be moved for immersion in said pan, a transverse exit door through which said spindle and coated discs may be moved for ultraviolet curing, means between said doors and above said pan defining an enclosed space for spinning off the excess of material from said discs, said entrance and exit doors being positioned when closed to drain off material for recirculation to said pan, a first pair of arms, one each positioned at each of said side walls, a common shaft connecting said arms, said first pair of arms having means adjacent the ends thereof for engaging said spindle at its opposite end upon rotation of said arms by said shaft, said arms being proportioned to move said spindle through said entrance door into said enclosed space, cam means on said side walls engageable with said first pair of arms at said coating region when said spindle is in said enclosed space for causing said arms to disengage said spindle, means in said side walls above said pan for receiving and supporting said spindle for coating at a precise height above said coating material, a spindle drive gear engageable with said spindle at said supporting means, means connected to said gear for causing said gear to drive said spindle by rotation thereof for coating the films on said discs, a second pair of spindle-receiving arms, one each mounted on each of said side walls, a common shaft connected said second pair of arms for rotation together about the axis of rotation of said gear, said second pair of arms being provided with means adjacent the ends thereof engageable with the respective ends of said spindle upon rotation of said arms for supporting said spindle substantially at the pitch diameter of said gear, motor means operable to drive said common shaft of a second pair of arms to cause said second pair of arms to engage said spindle and elevate said spindle above said pan out of contact with said material while maintaining engage-ment of said spindle with said gear whereby said spindle may be driven by said gear at an increased rate of rotation for spinning off excess coating material, means for causing said second arm motor means to rotate said spindle through said exit door about the pitch diameter of said gear, an ultraviolet curing lamp between said side walls and directed upon said spindle during movement thereof by said second pair of arms beyond said exit door for curing coating material on said discs, and means on said side wall engageable with said second pair of arms following curing for causing said second pair of arms to release said spindle.

* * * * *